United States Patent [19]

Fraioli

[11] Patent Number: 4,507,083

[45] **Date of Patent: * Mar. 26, 1985**

[54] GAS-FIRED INFRARED PROJECTION HEATER

[76] Inventor: Joseph Fraioli, 8 Seymour Pl., White Plains, N.Y. 10605

[ * ] Notice: The portion of the term of this patent subsequent to Feb. 21, 2000 has been disclaimed.

[21] Appl. No.: 569,022

[22] Filed: Jan. 9, 1984

Related U.S. Application Data

[63] Continuation-in-part of Ser. No. 420,927, Sep. 21, 1982, Pat. No. 4,432,727.

[51] Int. Cl.[3] ..... F23D 23/00

[52] U.S. Cl. ..... 432/227; 432/175; 432/222; 431/347; 126/91 A; 126/92 AC

[58] Field of Search ..... 432/175, 222, 227; 431/326, 328, 347; 126/92 AC

[56] References Cited

U.S. PATENT DOCUMENTS

| | | | |
|---|---|---|---|
| 1,486,036 | 3/1924 | Risinger | 126/92 AC |
| 1,529,871 | 3/1925 | Conroy et al. | 126/92 AC |
| 2,200,169 | 5/1940 | Hammick | 126/92 AC |
| 2,731,010 | 1/1956 | Moore et al. | 126/92 AC |
| 3,326,263 | 6/1967 | Milligan | 431/347 |
| 3,437,322 | 4/1969 | Hynn | 432/222 |
| 3,954,388 | 5/1976 | Hildebrand | 126/92 AC |
| 4,432,727 | 2/1984 | Fraioli | 432/227 |

*Primary Examiner*—Henry C. Yuen

*Attorney, Agent, or Firm*—Michael Ebert

[57] ABSTRACT

A gas-fired infrared heater for projecting an infrared beam in a radiation pattern having a predetermined geometry for irradiating the surface of a food product or other body to effect uniform heating thereof at a rapid rate. The heater includes a ribbon-type burner having an elongated pre-mix casing into which is fed air and gas, and an outlet extending along a slot in the casing and projecting therefrom. The outlet is provided with two sets of corrugated ribbons separated by a gas pressure chamber, whereby the air-gas mixture from the casing passes through one set into the chamber where the pressure thereof is equalized before the mixture passes through the other set from which it emerges as a sheet of flame of uniform intensity. The outlet is inserted in the longitudinal socket of a refractory body to impinge on a surface thereof whereby the surface is heated to a temperature level causing the surface to emit infrared energy which is projected by an array of radiation horns formed in the assembly.

8 Claims, 7 Drawing Figures

GAS-FIRED INFRARED PROJECTION HEATER

RELATED APPLICATION

This application is a continuation-in-part of my copending application Ser. No. 420,927, filed Sept. 21, 1982, U.S. Pat. No. 4,432,727 the entire disclosure of which is incorporated herein by reference.

BACKGROUND OF INVENTION

This invention relates generally to the heating of products with infrared (IR) energy, and more particularly to a gas-fired IR heater for projecting an IR beam in a radiation pattern having a predetermined geometry for irradiating the surface of the product to effect uniform heating thereof at a rapid rate.

The transfer of heat takes place by three processes: conduction, convection and radiation. In conduction, heat is transferred through a body by the short range interaction of molecules and/or electrons. Convection involves the transfer of heat by the combined mechanisms of fluid mixing and conduction. In radiation, electromagnetic energy is emitted toward a body and the energy incident thereto is absorbed by the body to raise its temperature. Radiant heating, therefore, differs from both convection and conduction heating, for the presence of matter is not required for the transmission of radiant energy.

According to the Stefan-Boltzmann law, the rate of heat transfer between a source of radiated heat whose temperature is $T_s$ and an absorbing body whose temperature is $T_b$ is equal to $T_s^4-T_b^4$; that is, to the difference between the fourth powers of these temperature values. In convection heating, the rate of heat transfer is proportional only to the temperature difference between the body being heated and the surrounding atmosphere. Hence convection heating is inherently very slow, as compared to the nearly instantaneous effects of radiant heating.

Though an IR heater in accordance with the invention may be used throughout the full range of heating applications, including industrial processes such as industrial finishing and textile treatment, as well as in annealing, curing and drying operations which require heating, it will mainly be described herein in connection with the heating of food products; for the invention has particular advantages in that context.

While a food product typically undergoes cooking or baking at a temperature in the range of about 140° to 200° F. whose upper value is below the boiling point of water (212° F.), it is nevertheless necessary in a conventional convection oven to establish a much higher oven temperature—usually well over 400° F. The reason for this requirement is that the transfer of heat between the hot atmosphere of the convection oven and the body of food takes place at a fairly rapid rate only when the temperature differential therebetween is great.

If, therefore, the food placed in an oven is initially at room temperature and the oven temperature is held at about 200° F., then as the body of the food becomes warmer and its surface temperature rises to, say, 150° F., the rate of heat transfer as the temperature differential narrows thereafter becomes increasingly slow, and the cooking or baking process is protracted. On the other hand, if the oven temperature is raised to 400° or 500° F. to speed up baking, this means that the entire volume of air in the oven must be at this elevated temperature, and this entails a relatively large energy expenditure. With rising energy costs, this factor adds substantially to the cost of baking and is reflected in the cost of the product to the consumer. Also, with convection ovens, the flow of hot air over the surface of the food product tends to deprive it of moisture and volatile constituents and therefore degrades the quality of the product.

Radiation heaters in present commercial use are of the infrared type, the infrared band of thermal radiation lying within the electromagnetic wave spectrum. The quality and intensity of radiation in the infrared band of 0.7 microns to 400 microns depends on the temperature of the radiating body. If, therefore, the radiating body is a refractory ceramic heated by a gas-fired jet burner, one can only accurately adjust the quality and intensity of the IR radiation if it is possible to carefully control the operation of the gas-fired burner.

Despite the fact that IR heaters are much more economical to operate and act with extreme rapidity, and IR heaters are therefore far superior in this regard to convection ovens for cooking or baking food, they have enjoyed limited success in the baking industry. The reason for this is that commercially available gas-fired IR heaters are relatively difficult to control and also give rise to an uneven baking action.

Effective infrared heating depends not only on the radiant source temperature but also on what is referred to as the "geometric view factor." This factor determines the relationship between the pattern of IR radiation and the surface of the product being heated. With the typical IR heating arrangement, portions of the product to be heated are more completely exposed to IR rays and will be heated more rapidly to a high temperature than those portions that are not as fully exposed. As a consequence, the product may not be properly baked and may not be commercially saleable.

This drawback of IR heating with existing equipment is recognized in the article "Radiant Convection Heating - A Marriage of Two Systems" by H. J. Bennett, which appears in the journal *Industrial Gas* for February 1976. In order to overcome the uneven heating experienced with IR heating, the author proposes combining an IR heater with a convection heater so as to provide a heating technique somewhat faster than convection heating, yet with the uniformity and controlled temperature characteristics of convection heating.

The fact is, however, that the synthesis of IR and convection heating represents a compromise that is not entirely satisfactory, for it requires much more energy than IR heating and also a confined oven as well as separate controls for the heater and the oven.

Ideally, with a food product, such as dough to be baked, having an exposed surface of given dimensions, the geometry of the IR beam impinging on this surface should be such as to impinge on all points thereon IR rays of equal intensity so that the baking is uniform throughout the body of the food. But existing IR heaters are incapable of producing an IR radiation pattern of uniform flux density which is so shaped as to uniformly irradiate and heat a given food product.

In my above-identified copending application, there is disclosed an infrared heater which makes use of a refractory assembly heated by a ribbon-type cylindrical gas-air burner producing a sheet of flame whose intensity may be adjusted to any desired level and maintained at that level, whereby the intensity of IR radiation emitted by the assembly may be accurately controlled to effect heating of food or any other body at a rapid rate.

The heater disclosed in my copending case is constituted by a refractory assembly formed by a stack of identical slabs having a bore therethrough to receive the cylinder of a controllable ribbon-type gas-air burner from whose longitudinal slot is emitted a sheet of flame. Each slab is provided with a sector-shape channel cut in one face thereof to define a fin and side walls that diverge from the bore to create a flattened IR radiation horn whose mouth is aligned with the burner slot, whereby the surface of the assembly on which the flame impinges is heated to a temperature level causing this surface to emit infrared energy. The parallel array of radiation horns created by the assembly produces a radiation pattern whose shape depends on the geometry of the channel.

While a heater of the type disclosed in my copending case operates effectively to produce infrared radiation, it has certain drawbacks which are due largely to the nature of the ribbon-type burner.

When the ribbon-type burner is of the known type disclosed, for example, in the Flynn U.S. Pat. No. 3,437,322, the gas-air fuel mixture is fed into a cylinder having a longitudinal slot therein occupied by a stack of corrugated ribbon to create an array of minute jet openings through which the gas-air mixture is expelled. Because of the myriad of jet openings, the projected flame is not composed of discrete jets but assumes a sheet-like form.

However, the intensity of the flame is not uniform throughout the length of the ribbon, for the pressure of the gas-air mixture in the cylinder is not equalized throughout its length. Hence, the resultant infrared radiation pattern is not of uniform intensity; and when food is subjected to this pattern, the heating thereof may be uneven.

Moreover, with the arrangement disclosed in my copending case, some of the infrared energy from the refractory body is directed back toward the ribbon-type heater. With prolonged operation, this infrared energy, which is absorbed by the metal cylinder of the heater, results in metal fatigue.

The following prior art patents are generally relevant to the present invention:

| | |
|---|---|
| Koch | 3,810,732 |
| Verazza | 3,690,626 |
| Heath | 3,825,406 |
| Hildebrand | 3,954,388 |
| Peregrine | 2,495,386 |
| Kennedy | 2,601,299 |
| Bockelman | 4,034,739 |
| Lazaridis | 4,202,661 |
| Flynn | 3,437,222 |

SUMMARY OF INVENTION

In view of the foregoing, the main object of this invention is to provide an infrared heater for projecting an IR beam in a radiation pattern having a predetermined geometry for irradiating the surface of a food product or other body to effect uniform heating thereof at a rapid rate.

More particularly, an object of this invention is to provide an infrared heater which makes use of a refractory assembly heated by a ribbon-type burner producing a sheet of flame whose intensity is uniform along the sheet.

Also an object of the invention is to provide an infrared heater of the single-burner or double-burner type.

A significant feature of the invention is that its ribbon-type burner includes means to equalize the the pressure exerted by the air-gas mixture so that the sheet of flame emitted therefrom has an intensity which is equalized.

Briefly stated, these objects are attained in a gas-fired infrared heater for projecting an infrared beam in a radiation pattern having a predetermined geometry for irradiating the surface of a food product or other body to effect uniform heating thereof at a rapid rate. The heater includes a ribbon-type burner having an elongated pre-mix casing into which is fed air and gas, and an outlet extending along a slot in the casing and projecting therefrom. The outlet is provided with two sets of corrugated ribbons separated by a gas pressure chamber, whereby the air-gas mixture from the casing passes through one set into the chamber where the pressure thereof is equalized before the mixture passes through the other set from which it emerges as a sheet of flame of uniform intensity. The outlet is inserted in the longitudinal socket of a refractory body to impinge on a surface thereof whereby the surface is heated to a temperature level causing the surface to emit infrared energy which is projected by an array of radiation horns formed in the assembly.

OUTLINE OF DRAWINGS

For a better understanding of the invention as well as other objects and further features thereof, reference is made to the following detailed description to be read in conjunction with the acccompanying drawings, wherein.

DESCRIPTION OF INVENTION

Figure 1:
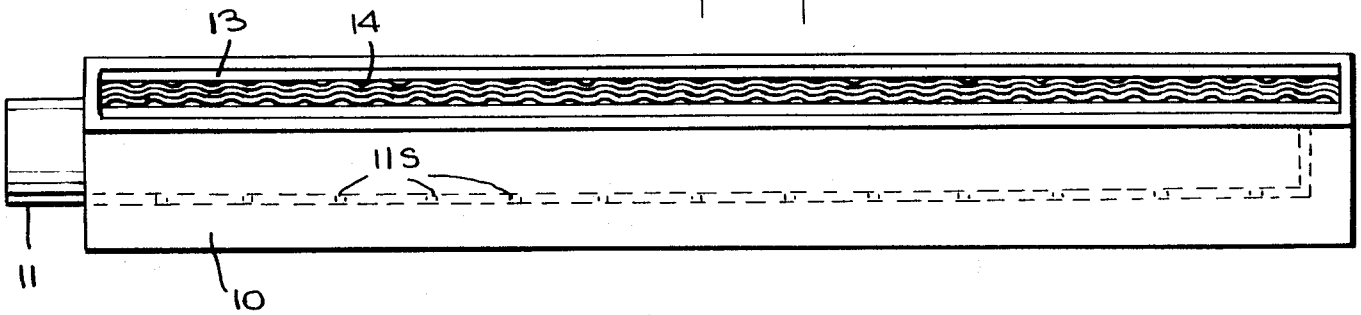
FIG. 1 is a front view of a single ribbon-burner which is usable with a refractory assembly to provide an infrared heater in accordance with the invention for projecting an infrared beam in a radiation pattern having a predetermined geometry.
Figure 2:
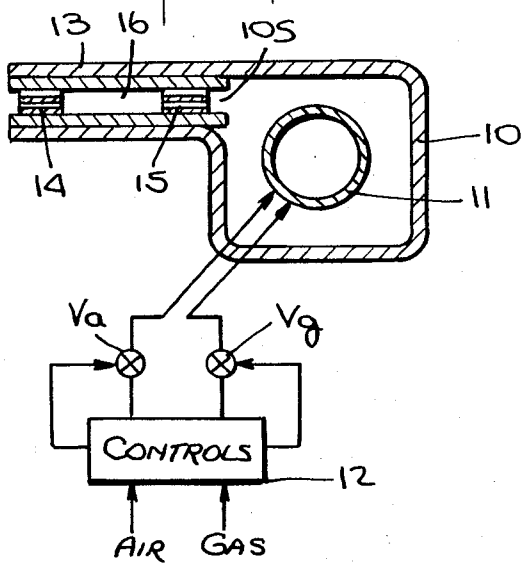
FIG. 2 is a transverse section taken through the ribbon burner in the plane indicated by line 2—2 in FIG. 1.

Single Burner IR Heater:

Referring now to FIGS. 1 and 2, there is shown a single ribbon-type burner for use in conjunction with a refractory assembly to form an IR heater in accordance with the invention.

The burner includes an elongated pre-mix casing 10 of a suitable metal such as steel. The casing of the burner is supplied through an inlet pipe 11 with a mixture of air and gas through a mixing and control system 12 which makes it possible automatically to adjust through valves $V_a$ and $V_g$ the ratio of gas to air to provide the desired stoichiometric ratio and to maintain this ratio at an adjusted flow rate, so that one may accurately vary the intensity of heat produced by the burner and the resultant temperature of the refractory surface of the assembly.

Cylinder 10 is provided with a longitudinally extending slot 10S communicating with outlet 13 projecting from the casing. The front end of the outlet is occupied by a stack of corrugated ribbons forming a first set 14. The corrugated ribbon stack creates an array of minute jet openings through which the gas-air mixture is forced. The configuration of the ribbons is such as to provide two distinct types of jet ports, one being a main flame jet port which is of the high velocity type causing the gas-air mixture to project with sufficient energy to form a long flame, the others on either side of the main flame jet port being pilot jet ports of the low velocity type to produce relatively short flames for sustaining the long main flame. Because of the longitudinally-extending outlet arrangement and the myriad jet openings created by the ribbons, the projected main flame is not composed of discrete jets, but assumes a sheet-like form.

At the inner end of outlet 13 is a parallel set 15 of corrugated ribbons. These are separated from the first set by an air-gas pressure chamber 16. In operation, the air and gas fed into casing 10 are pre-mixed therein, the mixture being forced through the second set of ribbons 15 to pass into the pressure chamber for more thorough secondary mixing therein.

Because the flow of the mixture through the outlet is retarded between the two sets of ribbons, both of which offer fluidic impedance, this retarding action serves to equalize the pressure in chamber 16. Thus while the pressure throughout the pre-mix chamber tends to vary at various regions therein, the pressure of the mixture when it is ejected into the atmosphere from the first set of ribbons is equalized, and the resultant sheet of flame has an equalized intensity giving rise to an infrared beam of uniform intensity.

Figure 4:
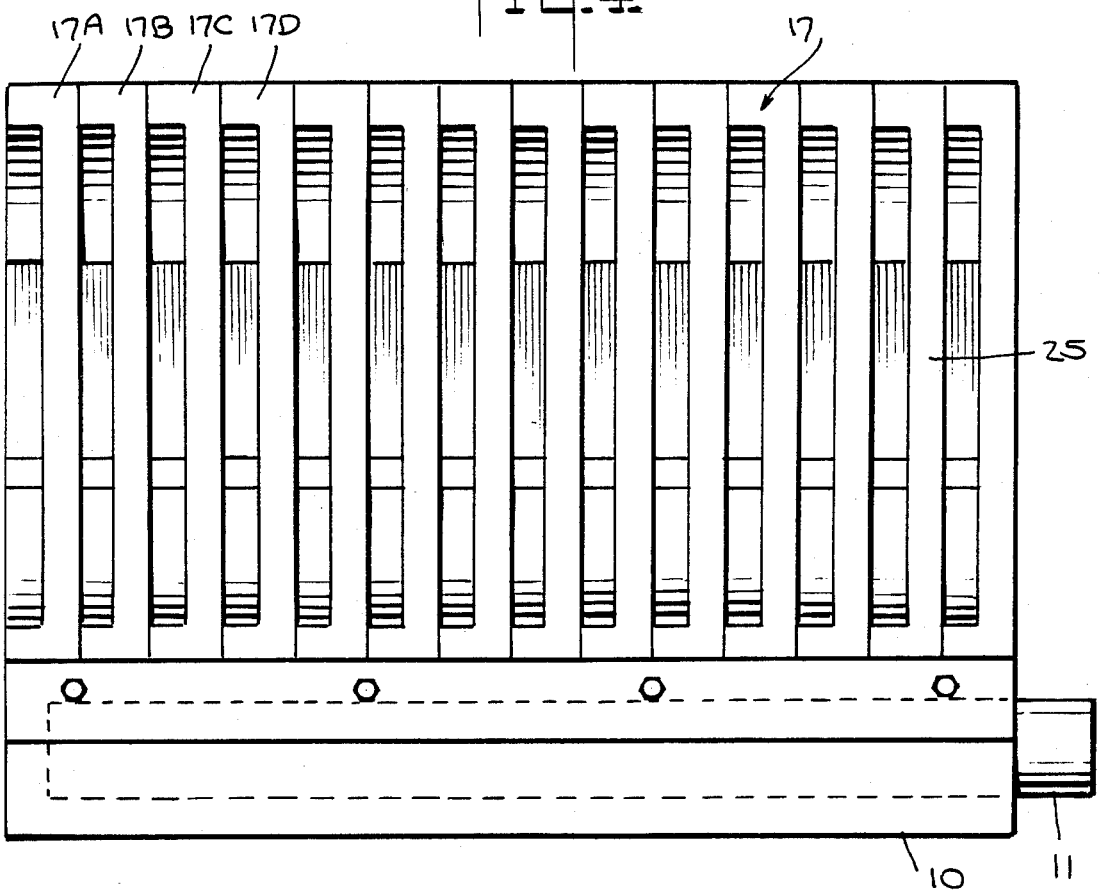
FIG. 4 is a front view of the single ribbon-burner infrared heater in accordance with the invention.
Figure 5:
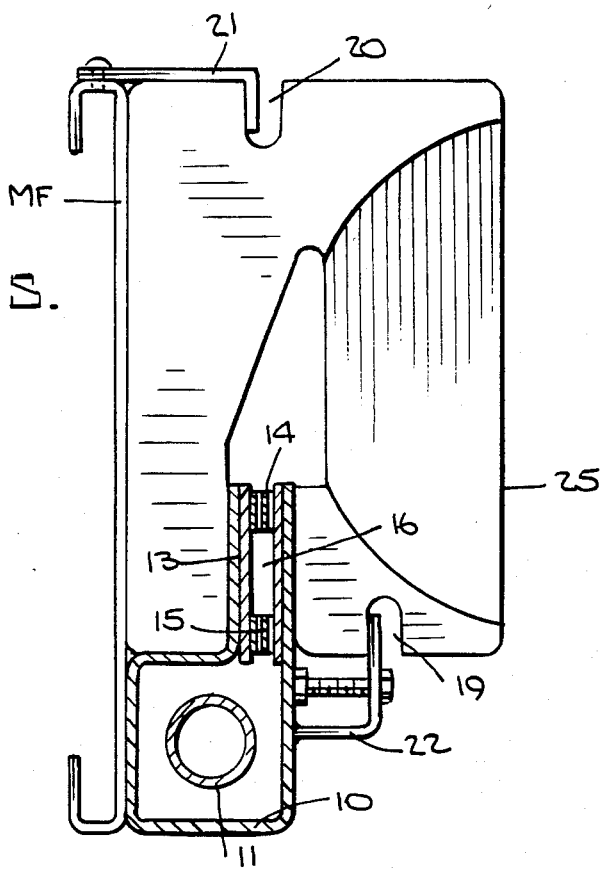
FIG. 5 is a side view of the single-burner heater.

The Refractory Assembly:

As shown in FIGS. 4 and 5, outlet 13 of the ribbon burner is inserted into a longitudinal socket formed in a refractory assembly, generally designated by numeral 17. The assembly is constituted by a stack of identical refractory slabs 17A, 17B, 17C, etc.

Figure 3:
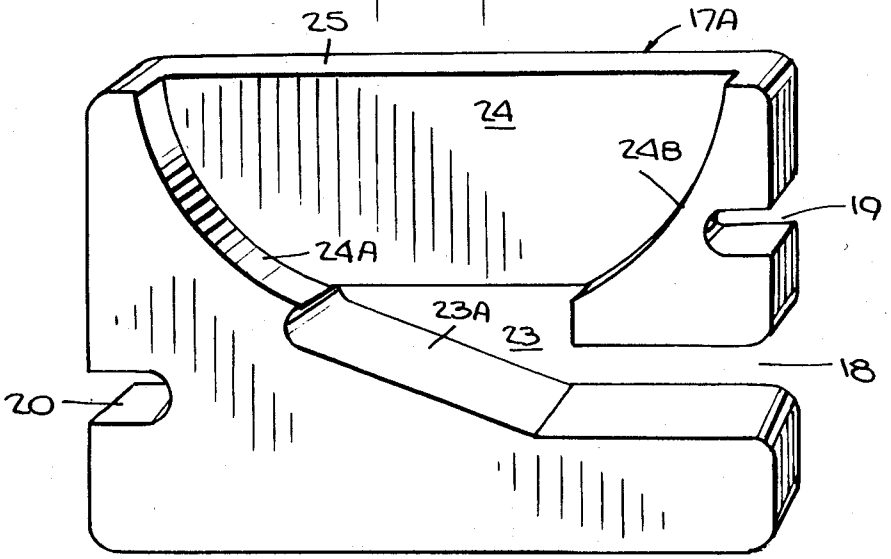
FIG. 3 shows, in perspective, one of the slabs of the refractory assembly.

One of these slabs, 17A, is shown in FIG. 3, where it will be seen that it is in rectangular form and includes a slot 18 forming the socket to receive the outlet 13 of the burner and notches 19 and 20 on opposite short sides thereof for mounting purposes. When the infrared heater is installed against a metal frame MF, as shown in FIG. 5, bracket 21, which is attached by a bolt to the frame, and bracket 22, which is attached by a bolt to casing 10, engage notches 19 and 20 to retain the unit against the frame.

Slot 18 in the slab which receives the burner outlet communicates with an interior cavity 23 having an inclined wall surface 23A onto which surface the flame from the burner impinges to produce a high density flux of maximum radiance. The flame is not the source of infrared radiation, for its function is to heat the surface of the refractory to a temperature level (i.e., 1800° to 2200° F.) at which the refractory then emits infrared energy in the micron range to effect the desired heating of the product subjected to the IR radiation pattern.

As the temperature of the refractory surface is increased, the maximum IR radiation occurs at shorter wavelengths and has a much higher intensity, with an increasingly greater portion of the radiation occurring nearer the visible range in the electromagnetic spectrum. Infrared rays travel in a straight line until they strike an absorbing surface; hence radiant heat follows the same physical laws as light waves and travel at the same speed.

Cut into one face of slab 17A is an indentation 24 having a concave formation whose opposing arcuate sides 24A and 24B diverge from interior cavity 23 toward the front of the slab, the uncut face of the slab defining a fin 25. Thus when slabs 17A, 17B, 17C, etc. are stacked to create the refractory assembly, each concave indentation is covered by the fin 25 of the adjacent slab to define a flattened radiation horn whose mouth communicates with cavity 23, the wall surface of which emits infrared energy.

The stack therefore provides a parallel array of radiation horns to produce a radiation pattern which depends on the geometry of the indentations that define the individual horns. The shape of these indentations is made such as to provide the desired pattern, and it need therefore not be concave.

Each slab is composed of refractory material, a preferred material for this purpose being "Cera Form," a refractory produce by Johns-Manville of Denver, Colorado, made from a wet slurry formulation that includes refractory fibers and multi-component binder systems. Thus "Cera Form" type 103 includes Alumina (39.6%) and Silica (50.7%). Because the material can be molded, it can be made into the special shapes called for in the present application. In practice, however, the refractory body may be molded in integral form rather than being made up of individual slabs.

In operation, infrared radiation emitted by inclined surface 23A is directed toward the radiating horn for projection toward a body to be heated. However, the angle of inclination is such that no radiant energy is directed toward the outlet of the ribbon burner; hence the burner is protected from the consequences of radiant heat.

While a fibrous refractory has been disclosed for the refractory assembly, in practice the infrared emitting material may be of a ceramic or other composition. And while a heater in accordance with the invention does not require an enclosure to confine heated air as in a convection oven, an enclosure may be used to minimize the loss of heat from the atmosphere heated by the irradiated body, for this atmosphere is then prevented from escaping.

In a conventional gas-fired infrared heater in which the surface of a refractory IR emitter is heated by a gas-fired jet burner, the nature of the burner is such that one cannot control the flame throughout a broad range extending from an extremely low level to a very high level. Hence the minimum flame setting of the burner is relatively high and the IR intensity at this setting is also high.

As a consequence, when a conventional gas-fired IR heater is to be used to heat dough or any other body to a relatively low temperature level no higher than, say, 300° F., in order to attain the desired level of body heat, one must locate the infrared emitter a substantial distance from the body, say, 20 inches or more, to avoid overheating. The resultant infrared beam directed toward the body then has rays in the central region thereof which are almost perpendicular to the body. The infrared rays in the outer region on either side of the central region are more or less inclined and therefore travel a longer distance, the intensity of the rays decreasing as the square of the distance. Hence the body in the area impinged on by the rays from the central region is raised to a higher temperature than the areas impinged on by the rays from the outer region, this action producing uneven heating.

But with an infrared heater in accordance with the invention in which a gas-fired ribbon type burner is used to heat the refractory IR emitter, one may operate this burner with an extremely small flame without losing the flame. This makes it possible to reduce the intensity of infrared radiation to a level making it feasible to bring the infrared heater as close as four inches to the surface of the body to be heated, in which case, all infrared rays impinging on the body travel a very short distance to effect uniform heating thereof.

Figure 6:
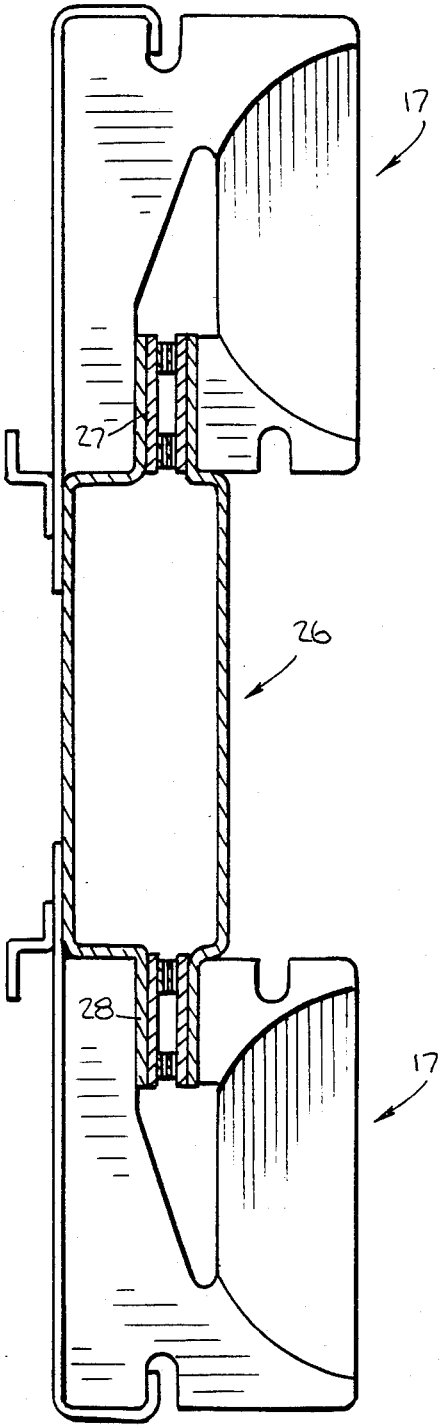
FIG. 6 is a side view of a double-burner heater in accordance with the invention.
Figure 7:
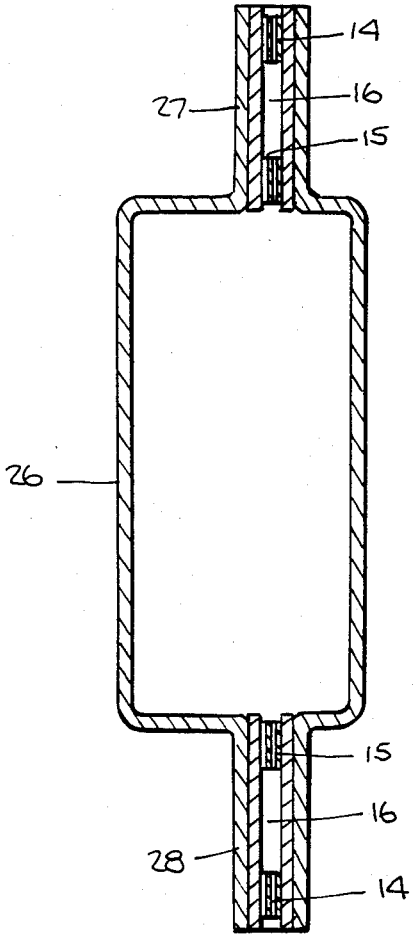
FIG. 7 is a separate side view of the double burner.

Double Burner IR Heater:

In the unit shown in FIGS. 6 and 7, the IR output of the structure is doubled by using a pair of refractory assemblies 17 in conjunction with a double burner, general designated by numeral 26.

Burner 26 is provided with a pre-mix casing having projecting outlets 27 and 28 on opposite sides thereof. Each outlet includes two parallel sets of corrugated ribbons which correspond to the sets in the outlet shown in conjunction with the single burner. These outlets are inserted into the sockets of the respective refractory assemblies, the operation of this unit being identical to that of the single burner unit, except for the doubling thereof.

While there has been shown and described a preferred embodiment of an improved gas-fired infrared projection heater in accordance with the invention, it will be appreciated that many changes and modifications may be made therein without, however, departing from the essential spirit thereof.

It is important to note in connection with FIG. 1 that inlet pipe 11 which feeds the fuel-air combustible mixture into casing 10, extends into the casing from one end thereof to a point adjacent the other end, and that the pipe is closed at its end. The fuel-air mixture is admitted into the casing through a series of equi-spaced slots 11*s* cut into the pipe and extending along its length.

Thus instead of the mixture shooting out into the casing from the inlet pipe at one end of the casing, it is ejected from a series of spaced openings. The pipe, therefore acts as a distributor which disperses the mixture uniformly throughout the casing. This arrangement minimizes turbulence of the mixture into the casing and ensures a more efficient operation.

I claim:

1. A gas-fired infrared heater for projecting a directional infrared radiation pattern for irradiating the surface of a product to effect substantially uniform heating thereof, said heater comprising:

A a gas-fired burner constituted by an elongated premixing casing supplied with air and gas, said casing having a longitudinal slot from which is projected an outlet having a first set of corrugated ribbons adjacent its front end, whereby emitted therefrom is a sheet of flame; and B a refractory body of a material radiating infrared energy when heated to an elevated temperature level having a longitudinal socket to receive the outlet of said burner, an internal cavity having a surface onto which the burner flame impinges to be heated thereby to a temperature level causing it to emit infrared radiation, and openings communicating with said cavity to define radiation horns to produce said directional infrared radiation pattern, the cavity surface onto which said flame impinges being inclined relative to burner outlet at an angle at which no infrared energy from this surface is directed toward said outlet.

2. A heater as set forth in claim 1, wherein said outlet includes a second set of ribbons adjacent the rear end thereof and spaced from said first set to define therebetween a pressure chamber acting to equalize the pressure of the air-gas mixture.

3. A heater as set forth in claim 1, wherein said casing has a rectangular cross section and is provided with an inlet into which said air and gas is supplied.

4. A heater as set forth in claim 3, wherein said casing is supplied with air and gas through a control system which adjusts and maintains the ratio of air to gas and the flow rate of the resultant mixture fed into the casing to vary the intensity of the sheet of flame to provide infrared emission of a desired intensity.

5. A heater as set forth in claim 1, wherein said casing is provided at either side with an outlet, each of which is associated with a refractory body.

6. A heater as set forth in claim 1, wherein said body is constituted by a stack of slabs each having a slot therein to form said longitudinal socket.

7. A heater as set forth in claim 6, wherein each slab includes an indentation cut into one face of the slab to define one of said openings.

8. A heater as set forth in claim 7, wherein said indentation has a concave form.

* * * * *